US008225528B2

(12) United States Patent
Yoon et al.

(10) Patent No.: US 8,225,528 B2
(45) Date of Patent: Jul. 24, 2012

(54) DRYER

(75) Inventors: Ju Han Yoon, Changwon-si (KR); Sang Hun Bae, Changwon-si (KR); Seon Il Heo, Changwon-si (KR); Yeon Sik Choi, Changwon-si (KR); Sang Jin Kim, Changwon-si (KR)

(73) Assignee: LG Electronics, Inc., Seoul (KR)

( * ) Notice: Subject to any disclaimer, the term of this patent is extended or adjusted under 35 U.S.C. 154(b) by 898 days.

(21) Appl. No.: 12/285,007

(22) Filed: Sep. 26, 2008

(65) Prior Publication Data

US 2009/0083988 A1 Apr. 2, 2009

(30) Foreign Application Priority Data

Sep. 27, 2007 (KR) ..... 10-2007-0097257
Jan. 3, 2008 (KR) ..... 10-2008-0000784

(51) Int. Cl.
*F26B 11/02* (2006.01)
*F26B 3/34* (2006.01)
*E06B 3/50* (2006.01)

(52) U.S. Cl. ..... 34/603; 34/260; 312/109

(58) Field of Classification Search ..... 34/260, 34/261, 603; 312/9.21, 9.22, 109, 120, 123, 312/125, 138.1
See application file for complete search history.

(56) References Cited

U.S. PATENT DOCUMENTS

| | | | | |
|---|---|---|---|---|
| 2,958,954 | A * | 11/1960 | Longenecker | 34/527 |
| 4,510,697 | A * | 4/1985 | Beasley et al. | 34/261 |
| 5,875,655 | A * | 3/1999 | Herman-Latack et al. | 68/17 R |
| 6,415,724 | B1 * | 7/2002 | Albrecht et al. | 110/180 |
| 7,356,945 | B2 * | 4/2008 | Choi et al. | 34/597 |
| 2004/0025368 | A1 | 2/2004 | Gerlach et al. | |
| 2008/0053875 | A1 * | 3/2008 | Calverley et al. | 209/534 |

FOREIGN PATENT DOCUMENTS

| | | | |
|---|---|---|---|
| CN | 1880541 | A | 12/2006 |
| DE | 34 08 136 | A1 | 9/1985 |
| DE | 3408136 | A1 * | 9/1985 |

* cited by examiner

*Primary Examiner* — Kenneth Rinehart
*Assistant Examiner* — John McCormack
(74) *Attorney, Agent, or Firm* — McKenna Long & Aldridge LLP

(57) ABSTRACT

A laundry dryer capable of effectively removing creases or rumples from an object to be dried, for example, laundry, and effectively removing odor from the laundry is disclosed. The laundry dryer includes a drum for accommodating an object to be dried, a rear supporter for covering a rear side of the drum, a substance supply device having an end arranged at the rear supporter, to supply a water-based substance to an interior of the drum, and a rear plate formed to constitute a rear wall of the dryer while partially exposing the substance supply device.

17 Claims, 7 Drawing Sheets

DRYER

This application claims the benefit of Korean Patent Applications No. 10-2007-0097257, filed on Sep. 27, 2007 and No. 10-2008-0000784, filed on Jan. 3, 2008, which are hereby incorporated by references for all purposes as if fully set forth herein.

BACKGROUND OF THE INVENTION

1. Field of the Invention

The present invention relates to a dryer, and more particularly to a laundry dryer capable of effectively removing creases or rumples from an object to be dried, for example, laundry, and effectively removing odor from the laundry.

2. Discussion of the Related Art

Typically, a dryer is a home appliance used to dry laundry completely washed, namely, an object to be dried, using hot air. Generally, such a laundry dryer includes a drum for accommodating an object to be dried therein, and a drive source for driving the drum, a heater for heating air introduced into the drum, and a blower unit for sucking air into the drum or outwardly discharging air from the drum.

Dryers may be classified into an electric type and a gas type in accordance with the type of the system for heating air, namely, the type of the heater. The electric type dryer heats air, using heat generated from an electrical resistance. On the other hand, the gas type dryer heats air, using heat generated in accordance with the combustion of gas. Dryers may also be classified into an exhaustion type and a condensation type. In the condensation type dryer, air, which has become humid after being heat-exchanged with an object to be dried, is circulated without being outwardly discharged. The air is heat-exchanged with ambient air through a separate condenser. In accordance with this heat exchange, condensed water is generated, and is then outwardly discharged. In the exhaustion type dryer, air, which has become humid after being heat-exchanged with an object to be dried, is directly discharged to the outside of the dryer. Dryers may also be classified into a top loading type and a front loading type in accordance with the object loading type. In the top loading type dryer, an object to be dried is loaded into the dryer through the top of the dryer. On the other hand, in the front loading type dryer, an object to be dried is loaded into the dryer through the front side of the dryer.

Meanwhile, conventional dryers as mentioned above have the following problems.

Typically, in a dryer, laundry spin-dried after being completely washed is loaded so that it can be dried. In this case, the laundry, which has been washed using water, has creases due to the principle of the water washing. In the drying procedure carried out in the laundry dryer, however, the creases cannot be completely removed. In order to remove the creases still present on objects, such as laundry, completely dried in conventional dryers, it is necessary to perform ironing.

Where clothes other than laundry completely washed are stored or used in a typical manner, creases, rumples, or holds (hereinafter, generally referred to as "creases") may be formed at the clothes. To this end, it has been required to develop an apparatus capable of conveniently removing creases generated during the storage or use of clothes.

SUMMARY OF THE INVENTION

Accordingly, the present invention is directed to a dryer that substantially obviates one or more problems due to limitations and disadvantages of the related art.

An object of the present invention is to provide a dryer capable of avoiding the formation of creases on an object completely dried and removing creases formed on the object.

Another object of the present invention is to provide a dryer, which can be easily manufactured, and can be easily serviced, so that it can be conveniently used.

Another object of the present invention is to provide a dryer capable of preventing occurrence of an accident.

Another object of the present invention is to provide a dryer capable of supplying steam or moisture mist, to perform, in addition to a general drying function, various additional functions.

Another object of the present invention is to provide a dryer, which can obviate the above-mentioned problems without a considerable change in the outer structure of the conventional dryer, and an increase in the distance between the front and rear walls of the dryer, so that the dryer can be easily installed.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dryer comprises: a drum for accommodating an object to be dried; a rear supporter for covering a rear side of the drum; a substance supply device having an end arranged at the rear supporter, to supply a water-based substance to an interior of the drum; and a rear plate formed to constitute a rear wall of the dryer while partially exposing the substance supply device.

In another aspect of the present invention, a dryer comprising a drum for accommodating an object to be dried, a rear supporter for covering a rear side of the drum, and a rear plate constituting a rear wall of the dryer further comprises a substance supply device having an end arranged at the rear supporter, to supply a water-based substance to an interior of the drum, wherein the rear plate is formed to partially expose the substance supply device.

The rear plate may comprise a cutout formed to partially expose the substance supply device. The dryer may further comprise a damage preventing member provided at the cutout, to prevent the substance supply device from being damaged by the cutout. This is because a sharp edge may be formed at the cutout, so that the substance supply device may be damaged by the sharp edge. The damage preventing member may also perform a function to prevent a user, a worker who manufactures the dryer or a service man from being injured by the sharp edge.

The cutout may be formed at an upper portion of the rear plate.

In detail, the rear plate may further comprise a coupling portion coupled to a top plate constituting a top wall of the dryer or to the rear supporter, an extension extending rearwardly from the coupling portion, to form a rearmost surface of the dryer, and a connecting portion connecting the coupling portion and the extension.

The cutout may be formed through the connecting portion. Alternatively, the cutout may be formed to extend along the coupling portion and the connecting portion.

The substance supply device may comprise a hose providing a substance flowing passage. The hose may be connected to the rear plate. The cutout may outwardly expose a portion of the hose connected to the rear plate. The substance supply device may further comprise a nozzle provided at an end of the hose. The nozzle may be coupled to the rear supporter.

The water-based substance may comprise mist sprayed under a water pressure. Alternatively, the water-based substance may comprise steam.

In the latter case, the dryer may further comprise a steam generator arranged inwardly of the rear supporter, to generate steam. The substance supply device may comprise a hose connected to the steam generator at one end of the substance supply device. The hose may extend rearwardly beyond the rear supporter at the other end of the substance supply device.

The dryer may further comprise a cover for covering an exposed portion of the substance supply device, to selectively open/close the exposed portion. The cover may be provided at the rear plate.

The cover may comprise an opening/closing member pivotally movable between an opened position and a closed position, and a frame coupled to the rear plate, to support the opening/closing member such that the opening/closing member is pivotally movable.

The cover may be arranged such that, when the cover closes the exposed portion of the substance supply device, a rearmost surface of the cover is positioned inwardly of a rearmost surface of the rear plate. The dryer may further comprise a refractory material provided at an inner surface of the cover.

The rear plate may comprise a cutout formed to partially expose the substance supply device. The cover may comprise a damage preventing member provided at the cutout, to prevent the substance supply device from being damaged by the cutout.

In accordance with the present invention, it is possible to provide a dryer capable of eliminating problems incurred in conventional dryers, and preventing or eliminating formation of creases on an object completely dried.

In accordance with the present invention, it is possible to provide a dryer capable of being easily manufactured, easily serviced, and conveniently used.

In accordance with the present invention, it is possible to provide a dryer capable of preventing generation of an accident.

In accordance with the present invention, it is possible to provide a dryer capable of supplying steam or fine moisture as well as hot air, thereby performing various additional functions, in addition to a general drying function.

In accordance with the present invention, it is possible to provide a dryer capable of substantially obviating problems incurred in the related art, and achieving an easy installation thereof without considerably changing the outer structure of the dryer, and without increasing the distance between the front and rear ends of the dryer.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention associated with a dryer, examples of which are illustrated in the accompanying drawings.

Hereinafter, a basic configuration of a dryer according to an exemplary embodiment of the present invention will be described with reference to FIGS. 1 and 2.

Figure 1:
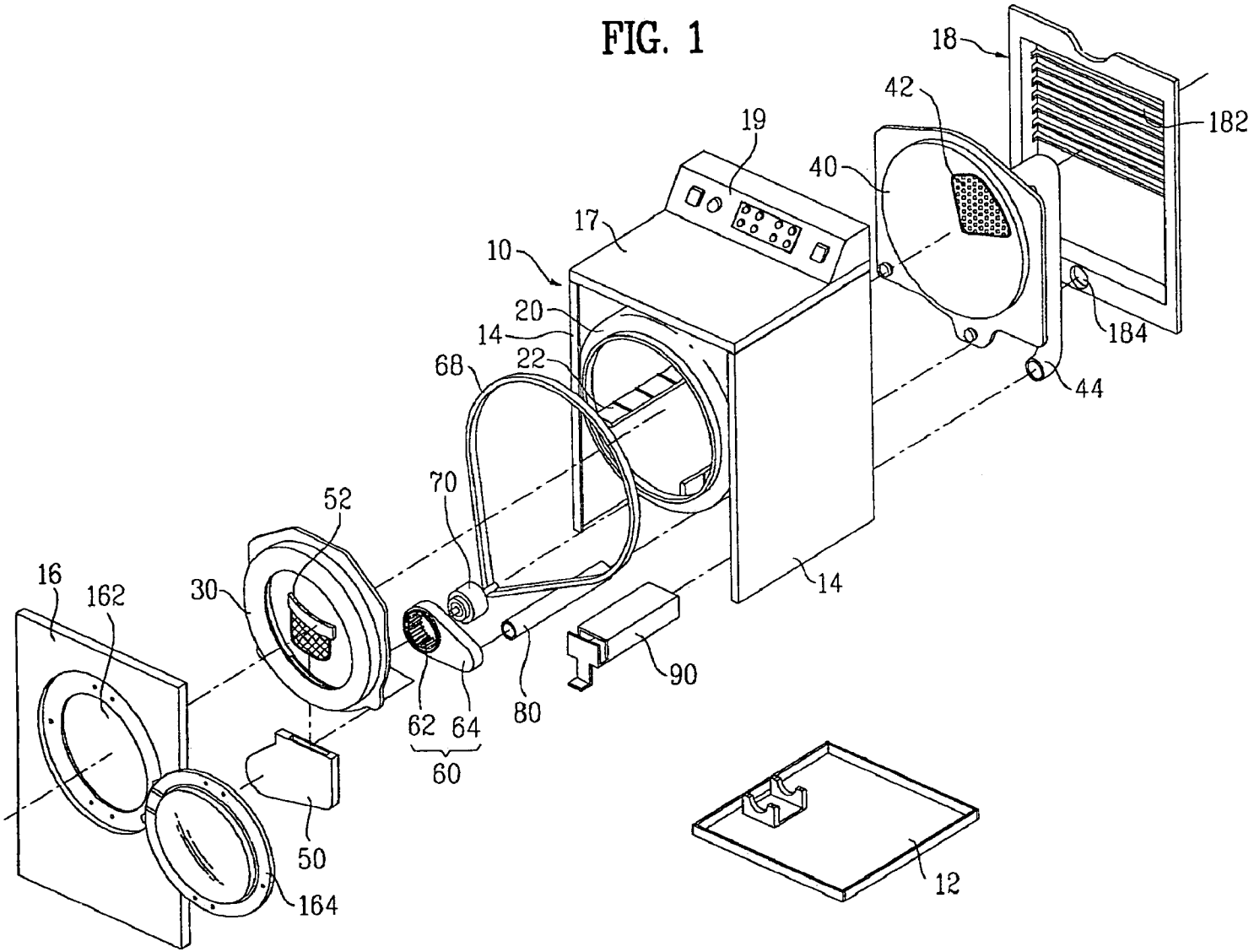
FIG. 1 is an exploded perspective view illustrating a dryer according to an exemplary embodiment of the present invention.
Figure 2:
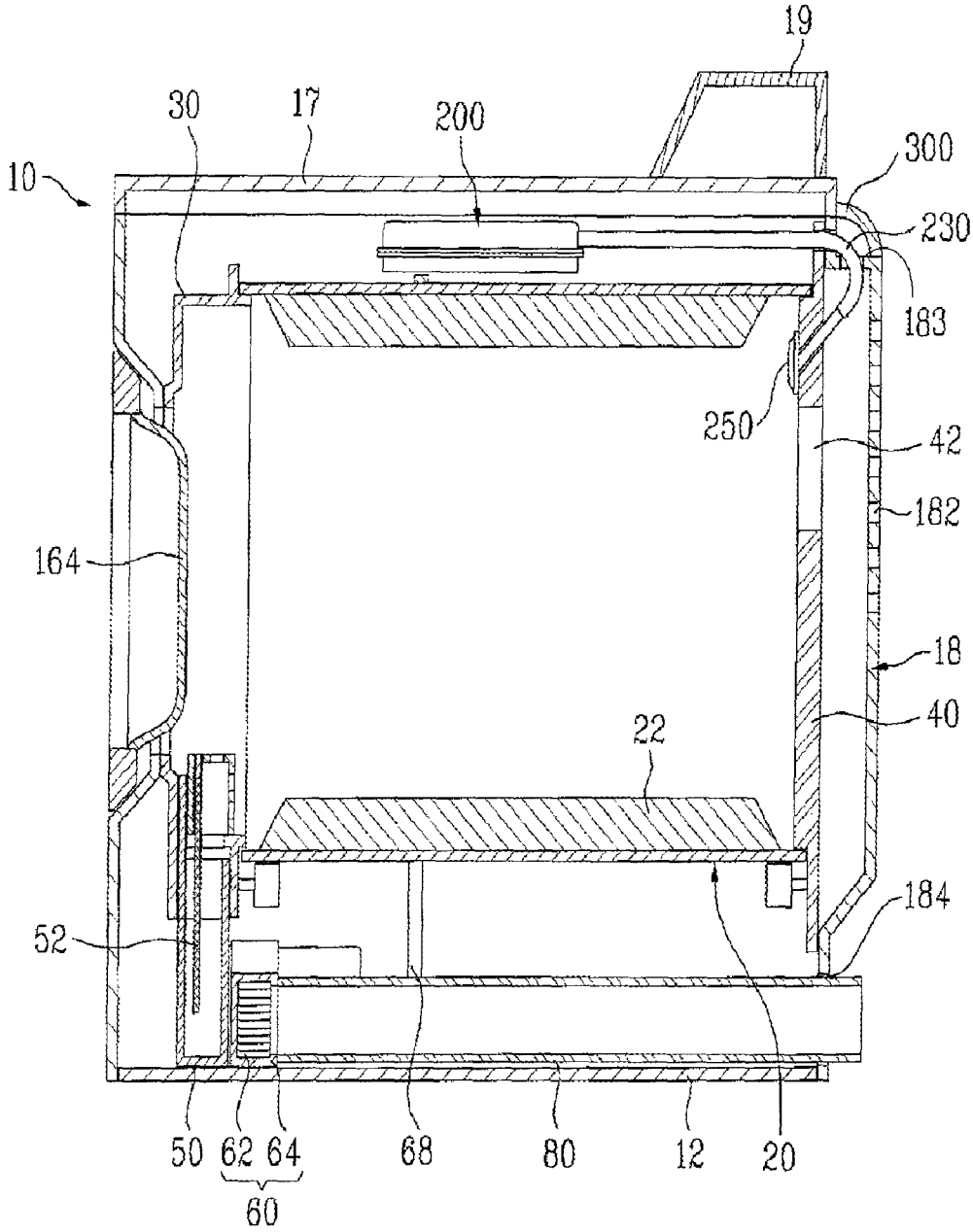
FIG. 2 is a sectional view of the dryer shown in FIG. 1.

As shown in FIGS. 1 and 2, the dryer according to the illustrated embodiment of the present invention includes a cabinet 10 forming an outer appearance of the dryer, and a drum 20 rotatably installed in the cabinet 10. The dryer also includes a motor 70 and a belt 68 to drive the drum 20.

An air heater 90 is arranged in the cabinet 10 at a desired position, to heat air, and thus to generate hot air. A hot air supply duct 44 is also arranged in the cabinet 10, to supply the hot air generated by the air heater 90 to the drum 20.

In the cabinet 10, an exhaust duct 80 for exhausting humid air heat-exchanged with objects to be dried in the drum 20, and a blower unit 60 for sucking the humid air are also arranged.

Although an indirect drive type, in which the motor 70 and belt 68 are used to rotate the drum 20, is illustrated and described in this embodiment, the present invention is not limited thereto. That is, a direct drive type, in which a motor is directly connected to a rear wall of the drum 20, to directly rotate the drum 20, may be applied to the present invention.

Also, although an exhaustion type dryer is described in this embodiment, for the convenience of description, the present invention is not limited thereto. For example, the present invention may also be applied to a condensation type dryer, in which a separate condensing duct (not shown) is provided to condense humid air heat-exchanged with an object to be dried, and thus to again supply dry air to a drum.

Hereinafter, the above-described constituent elements will be described in more detail.

The cabinet 10, which forms the outer appearance of the dryer, includes a base 12 forming a bottom wall, a pair of side plates 14 extending vertically from the base 12, front and rear plates 16 and 18 respectively mounted to front and rear ends of the base 12 where the side plates 14 are not arranged, and a top plate 17 disposed on the upper ends of the side plates 14.

A control panel 19, which includes operating switches, a display, etc., may be arranged on the top plate 17 or front plate 16. In this embodiment, the control panel 19 is illustrated as being arranged on the top plate 17.

A louver 182 is provided at the rear plate 18, to introduce ambient air into the cabinet 10. An exhaust hole 184 is also provided at the rear plate 18, as a passage for finally discharging air from the drum 20 to the outside of the drum 20. It is preferred that lifters 22 be installed in the drum 20, to turn over laundry in the drum 20, and thus to achieve an enhancement in drying efficiency.

A front supporter 30 is arranged in rear of the front plate 16. A rear supporter 40 is arranged in front of the rear plate 18. The drum 20 is rotatably supported between the front supporter 30 and the rear supporter 40.

Sealing members (not shown) are fitted between the front supporter 30 and the drum 20 and between the rear supporter 40 and the drum 20, respectively, to prevent water leakage. Of course, the front supporter 30 may have, at a central portion thereof, an opening, through which an object to be dried can be loaded/unloaded. However, the rear supporter 40 completely covers the rear side of the drum 20, to prevent an object to be dried from being loaded/unloaded through the rear side of the drum 20.

That is, the front supporter 30 and rear supporter 40 close the front and rear ends of the drum 20, to define a drying chamber in the drum 20. The front supporter 30 and rear supporter 40 also function to support the front and rear ends of the drum 20.

An opening 162 is formed through the front plate 16, to communicate the drum 20 with the outside of the dryer. The opening 162 is selectively opened or closed by the door 164. A lint duct 50, which is a passage for outwardly discharging air from the drum 20, is connected to the front supporter 30. A lint filter 52 is installed in the lint duct 50.

One side of the blower unit 60 is connected to the lint duct 50. The other side of the blower unit 60 is connected to the exhaust duct 80. The exhaust duct 80 communicates with an exhaust hole 184 provided at the rear plate 18.

Accordingly, when the blower unit 60 operates, air present in the drum 20 is exhausted from the drum 20 via the lint duct 50, exhaust duct 80, and exhaust hole 184. During this operation, foreign matter such as lint is filtered out by the lint filter 52.

Typically, the blower unit 60 includes a blower 62, and a blower housing 64. Typically, the blower 62 is connected to the motor 70, which drives the drum 20. Of course, the blower 62 may be driven by a motor (not shown) separate from the motor 70.

An inlet port 42, which is constituted by a plurality of through holes, is formed through the rear supporter 40. A hot air supply duct 44 is connected to the inlet port 42. The hot air supply duct 44 communicates with the drum 20 via the inlet port 42 of the rear supporter 40, to function as a passage for supplying hot air to the drum 20. To this end, the air heater 90 is installed at a certain position in the hot air supply duct 44.

Meanwhile, the dryer according to the present invention includes a substance supply device for supplying a water-based substance to the interior of the drum 20.

The water-based substance may be steam generated as water is heated. In this case, the substance supply device may be a steam supply device, which supplies steam.

Hereinafter, effects obtained when the dryer uses steam will be described in brief.

Typically, the dryer dries an object to be dried, using hot air. However, creases or rumples may be formed on the object as the drying operation proceeds. For this reason, an ironing operation may be required after the object is completely dried. However, it is possible to reduce or eliminate the formation of such creases or rumples by supplying steam to the object during the drying operation. That is, when steam is supplied to a creased or rumpled portion of the object, to supply moisture to the creased or rumpled object portion, and the object is then dried using hot air, creases or rumples from the creased or rumpled object portion are removed as the moisture is evaporated by the hot air. Accordingly, it may be preferred that the supply of the steam be initiated after the object is dried to some degree in accordance with the drying operation.

Meanwhile, steam has the form of hot fine water particles having a particle size of several microns. Accordingly, such steam supplies moisture and high-temperature heat to the object to be dried, thereby removing odor particles from the object. Thus, it is possible to effectively remove odor through a dryer using steam.

Also, it is possible to supply a certain amount of moisture to the object to be dried, namely, laundry, using steam, before the completion of the drying operation. Of course, the supply of moisture in a certain amount using steam may be carried out after the completion of the drying operation. As moisture is uniformly supplied to the laundry, using steam, it is possible to prevent static electricity from being generated from the laundry when the user unloads the laundry from the drum, and thus to prevent the user from feeling unpleasant due to static electricity.

Here, steam is a medium for supplying moisture and high-temperature heat to the object to be dried. Since steam has the form of very fine particles, as described above, it can effectively penetrate the object. Accordingly, moisture can be uniformly absorbed into the overall portion of the object. In other words, it is possible to effectively prevent moisture from being excessively absorbed into only a particular portion of the object.

Where steam is used as described above, it is possible to provide additional functions to the dryer. That is, the dryer can have, in addition to a simple drying function, additional functions such as removal or prevention of creases, removal of odor, removal of static electricity, and addition of moisture to laundry in an amount desired to achieve an easy ironing operation. Thus, an enhancement in user satisfaction can be achieved.

The water-based substance may be water. For example, the water-based substance may be water supplied to the interior of the drum. In the present invention, however, it is important to prevent water from being supplied in a large amount to the interior of the drum, as in a washing machine, in that the present invention is based on a dryer. This is because no drainage device is provided in a typical dryer, and a large amount of energy may be wasted due to a re-drying operation.

Accordingly, where the water-based substance is water, it is preferred that the water be mist injected or sprayed under a water pressure. In this case, the substance supply device may be a mist supply device, which supplies mist. Such mist can uniformly supply a certain amount of moisture to the object to be dried, without completely wetting the object. In this case, the steam generator, which generates steam, may be dispensed with.

The temperature of the mist is not high because the mist is formed as water of ambient temperature is sprayed. Also, the particle size of the mist may be several ten microns. For this reason, the mist may be supplied to a particular portion of the object, without being uniformly supplied to the overall portion of the object, as compared to steam.

In order to eliminate this possibility, it is necessary to heat the mist to a high temperature. That is, it is necessary to make the mist similar to the above-described steam by as much as possible.

As described above, the dryer includes an air supplier (the hot air heater, blower unit, etc.) to supply hot air or cold air to the interior of the drum. In this regard, it is preferable to control the air supplier such that the air supplier operates to supply hot air to the drum when the mist is supplied to the drum. In this case, the mist is heated, so that it is partially vaporized. As a result, the particle size of the mist is reduced. In addition, as the temperature of the mist increases, moisture can be uniformly and deeply absorbed into the object. In order to obtain a more effective synergy of the mist with hot air, it is preferred that the position of a nozzle, from which the mist is sprayed, be approximate to the position of the inlet port 42, through which hot air is introduced into the drum.

That is, the nozzle, which supplies fine moisture to the interior of the drum, may be provided at the rear supporter 40 such that the nozzle is arranged near the inlet port 42.

Of course, the nozzle may be arranged in the hot air supply duct 44. In this case, the mist may be supplied to the interior of the drum through the inlet port 42, together with hot air, after being heated in the hot air supply duct 44.

Alternatively, the water-based substance may be an additive for adding fragrance to the object to be dried. In this case, it is preferred that the additive be supplied to the drum in the form of mist, as in the case of water.

Hereinafter, the present invention will be described in detail, in conjunction with the case in which the water-based substance is steam A steam generator 200 according to an exemplary embodiment of the present invention generates steam. Water is supplied to the steam generator 200 which, in turn, heats the supplied water, to generate steam. The steam generator 200 may receive water supplied from a water supplier connected to an external water tap. Alternatively, the steam generator 200 may receive water from a tank (not shown) equipped in the dryer via a water supplier. In the latter case, a pump (not shown) for pumping water may further be provided.

The steam generated from the steam generator 200 is supplied to the drum 20 via the substance supply device.

Hereinafter, an exemplary embodiment of the steam generator 200 will be described with reference to FIG. 3.

The steam generator 200 includes a water tank 210 for containing water therein, and a heater 240 mounted in the water tank 210. The steam generator 200 is connected with a water supply hose 220 to supply water to the steam generator 200. The steam generator 200 is also connected with a steam hose 230 to discharge steam from the steam generator 200. Preferably, a nozzle 250 having a certain shape is arranged at an end of the steam hose 230 opposite to the steam generator 200. The water supply hose 220 may be connected to an external water supply source such as a city water tap, at an end of the water supply hose 220 opposite to the steam generator 200. The end of the steam hose 230 opposite to the steam generator 200 or the nozzle 250 is disposed at a desired position in the drum 20, to spray steam into the interior of the drum 20. Of course, the water supply hose 220 may be connected to a tank (not shown), which is mounted in the cabinet 10, to store a certain amount of water, without being connected to an external water supply source such as a city water tap.

In this case, the water supply hose 220 functions as the water supplier, whereas the steam hose 230 and nozzle 250 function as the substance supply device.

Without providing the nozzle 250, it may be possible to supply steam by arranging the end of the steam hose 230 opposite to the steam generator 200 in the interior of the drum 20. However, it is preferred that the nozzle 250 be provided at the end of the steam hose 230 because the nozzle 250 functions to provide an effective steam spraying angle and an effective steam distribution in the drum. Of course, the nozzle 250 can be integrated with the steam hose 230.

Figure 3:
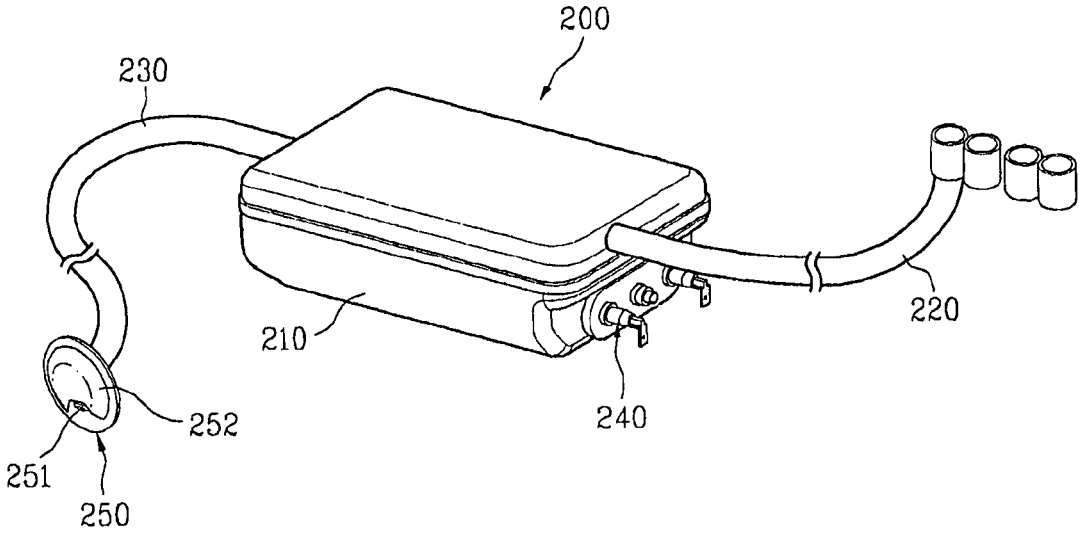
FIG. 3 is a view illustrating a steam generator installed in the dryer shown in FIG. 1.

Although the water supplier is illustrated as being arranged at one side of the steam generator 200, and the substance supply device is illustrated as being arranged at the other side of the steam generator 200, in the case of FIG. 3, the present invention is not limited thereto. For example, the water supplier and substance supply device may be arranged at the same side of the steam generator 200. Thus, the installation positions of the water supplier and substance supply device may be appropriately changed.

The steam generator 200 may have a configuration different from the above-described configuration. For example, the steam generator 200 may be configured to heat water flowing through a pipe-shaped housing (not shown), for the generation of steam, without heating water contained in the water tank 210. For convenience of description, the former steam generator is referred to as a "barrel type steam generator", and the latter steam generator is referred to as a "pipe type steam generator".

The pipe type steam generator can greatly reduce the time taken to generate steam, as compared to the barrel type steam generator, because the pipe type steam generator generates steam by rapidly heating water. In the pipe type steam generator, however, there may be a problem in that hot water other than steam may be supplied to the interior of the drum. As compared to the pipe type steam generator, the barrel type steam generator has an advantage in that it is possible to stably supply steam to the interior of the drum.

Hereinafter, the installation positions of the steam generator 200 and substance supply device will be described in detail with reference to FIG. 2.

It is preferred that the steam generator 200 be arranged above the drum 20, namely, between the top of the drum 20 and the top plate 17. This is because the space defined between the drum 20 and the top plate 17 corresponds to a relatively-empty space portion of the interior of the cabinet 10, so that superior space utility can be obtained when the steam generator 200 is arranged between the drum 20 and the top plate 17. Where the steam generator 200 is arranged in the above-described space, there is an advantage in terms of service because, when the steam generator 200 is out of order, it is possible to repair the steam generator 200 after separating the top cover 17.

Meanwhile, such an arrangement may be applied to the case in which mist is supplied to the interior of the drum, as described above. That is, the tank (not shown) for storing water, the pump (not shown), etc. may be arranged at the same position as the steam generator 200.

In either case, accordingly, it is preferred that the hose 230, which constitutes the substance supply device, extend rearwardly beyond the rear supporter 40. Where the water-based substance is steam, the hose 230 may be a steam hose. On the other hand, where the water-based substance is water, the hose 230 may be a typical water hose. The material of the hose 230 may be varied in accordance with the kind of the substance flowing through the hose 230.

It is also preferred that, of the hose 230 and nozzle 250 constituting the substance supply device, the nozzle 250 be mounted to the rear supporter 40. In this case, the hose 230 may be connected to the rear supporter 40 via the nozzle 250.

Where the nozzle 250 is mounted to the rear supporter 50, it is preferred that the nozzle 250 be directed to a central portion of the drum 20. This will be described in detail later.

Figure 4:
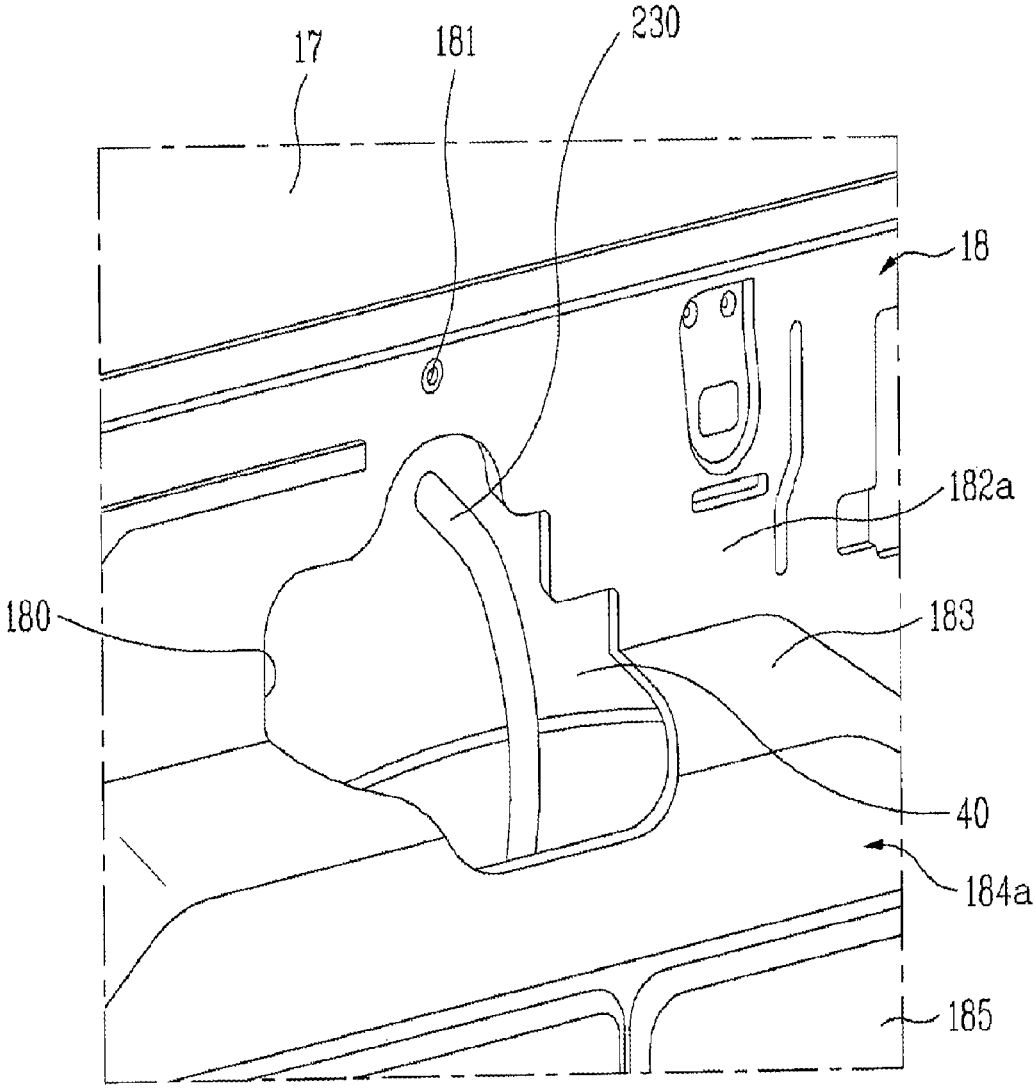
FIG. 4 is an enlarged view of a rear upper portion of the dryer shown in FIG. 1.

It is also preferred that the rear plate 18, which forms the rear wall of the cabinet 10, be configured to expose at least a portion of the substance supply device. To this end, the rear plate 18 may be formed with a cutout 180, as shown in FIG. 4.

Preferably, the cutout 180 is formed to expose the hose 230 and nozzle 250 constituting the substance supply device. That is, it is preferred that the cutout 180 be formed at a position corresponding to a region where the hose 230 and nozzle 250 are arranged. Accordingly, where the nozzle 250 is arranged at an upper portion of the drum while being supported by the rear support 40, it is preferred that the cutout 180 be formed at an upper portion of the rear plate 18.

The reason why the cutout 180 is formed at an upper portion of the rear plate 18 is that, when a failure occurs in the steam hose 230 or nozzle 250, it is possible to easily repair the failed steam hose 230 or nozzle 250 through the cutout 180. That is, an enhancement in serviceability is achieved. In other words, it is possible to achieve easy service without a separation of the rear plate 18.

The mounting of the nozzle 250 to the rear supporter 40 can be carried out in a region other than the interior of the drum, for example, at the rear side of the rear supporter 40. When the mounting of the nozzle 250 is carried out in the interior of the drum, the mounting process is very difficult due to the length of the drum. On the other hand, when the rear supporter 40 is assembled to the drum 20 under the condition in which the nozzle 250 has been mounted to the rear supporter 40, the hose 230 may be damaged, and the assembly process may be difficult due to the hose 230.

In this regard, it is possible to very easily achieve the assembly process by assembling the rear supporter 40 to the drum 20, and then performing the mounting of the nozzle 250 to the rear supporter 40 at the rear side of the rear supporter 40. Since a portion of the nozzle 250 and a free end of the hose 230 are exposed through the cutout 180, the mounting of the nozzle 250 to the rear supporter 40 can be achieved irrespective of the assembly order of the rear plate 18. Thus, the assembly process can be very easily achieved.

Meanwhile, preferably, the cutout 180 is normally in a covered state, and is selectively exposed, if necessary. This is because the user may be injured by the cutout 180 of the rear plate 18. Also, the user may get burned when he comes into contact with the hose 230, through which hot steam flows. In addition, when the hose 230 is in an outwardly-exposed state, it may be damaged by external environments.

In this regard, it is preferred that the dryer according to the present invention include a cover 300 for covering the cutout 180 such that the cutout 180 can be selectively opened, in order to achieve an enhancement in serviceability and to prevent the user from being subjected to an accident. Preferably, the cover 300 is separably coupled to the rear plate 18.

Figure 5:
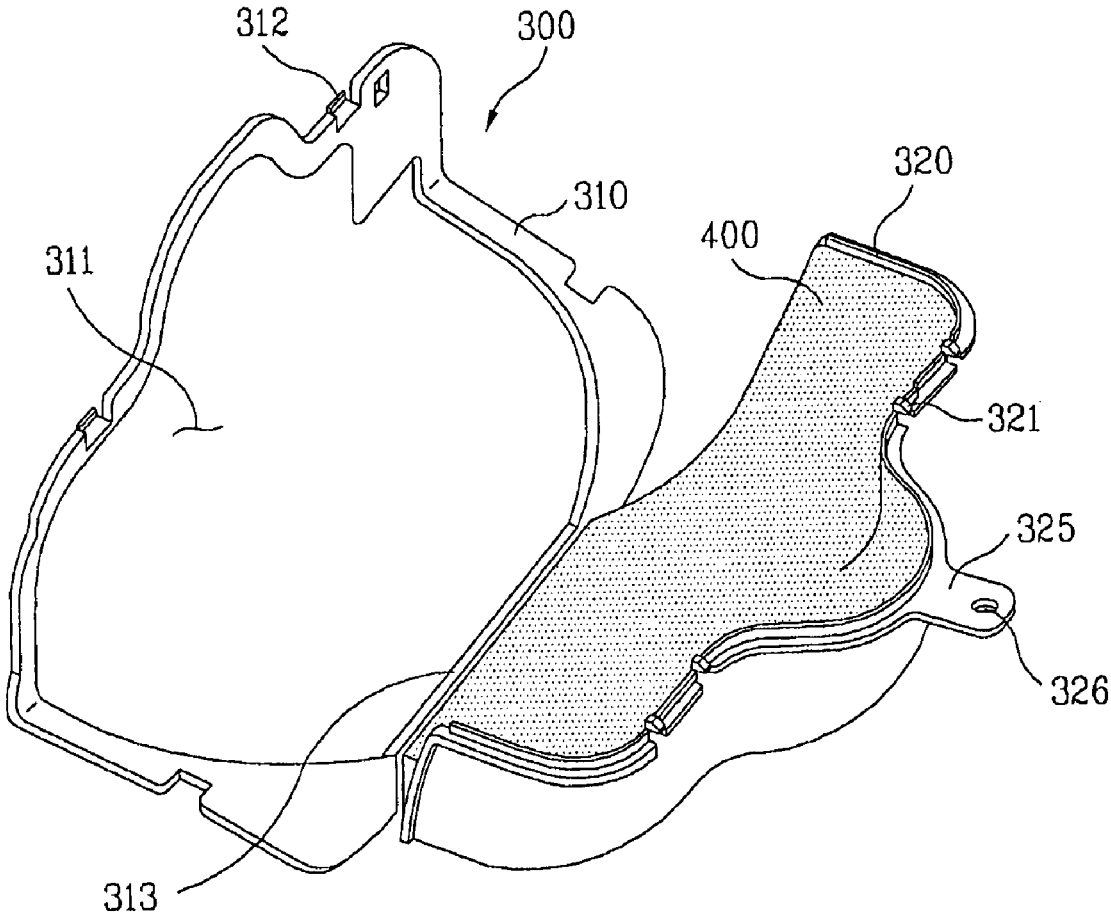
FIG. 5 is a perspective view illustrating a cover provided at the dryer in accordance with an exemplary embodiment of the present invention.

As shown in FIG. 5, the cover 300 includes a frame 310 having a shape corresponding to the shape of the cutout 180. An opening 311 is formed through the frame 310. The cover 300 also includes an opening/closing member 320 coupled to the frame 310 by a hinge 313, to open/close the opening 311 of the frame 310.

Where the frame 310 and opening/closing member 320 are prepared in the form of separate members, respectively, the hinge 313 functions to pivotally couple the frame 310 and opening/closing member 320. On the other hand, where the frame 310 and opening/closing member 320 are integrally formed, the hinge 313 may be provided by forming a connecting portion of the frame 310 and opening/closing member 320 such that the connecting portion is thinner than other portions, to perform a hinge function.

Preferably, the cover 300 is made of a synthetic resin different from the material of the rear plate 18. In particular, it is preferred that the cover 300 be made of polypropylene exhibiting excellent properties in terms of rigidity, impact resistance, and electrical characteristics. Since the cutout 180 is covered by the cover 300, as described above, it is possible to prevent the user or service man from getting burned as he comes into contact with the steam hose 230. It is also possible to prevent the user or service man from being injured by a sharp portion of the cutout 180.

A plurality of hooks 312 may be formed at the frame 310 of the cover 300, in order to separably couple the cover 300 to the rear plate 18, and to easily achieve the coupling of the cover 300 to the rear plate 18. Each hook 312 extends from a periphery of the frame 310 while having an inverted-L shape, in order to allow the cutout edge of the rear plate 18 to be fitted between the frame 310 and the hook 312. Thus, the cover 300 can be firmly coupled to the rear plate 18.

In addition to the hooks 312, which separably couple the cover 300 to the rear plate 18, the cover 300 may be separably coupled to the rear plate 18 by typical means such as a screw. Since the frame 310 has elasticity as it is made of polypropylene, the hooks 311 can be easily engaged with the cutout edge of the rear plate 18 in accordance with an elastic deformation of the frame 310.

It is preferred that the frame 310 and opening/closing member 320 be integrally formed at one side thereof such that the opening/closing member 320 can open/close the opening 311.

In this case, a plurality of engagement portions 321 are formed at the opening/closing member 320, which opens/closes the opening 311. By the engagement portions 321, the opening/closing member 320 may be temporarily coupled to the frame 310 in a state of closing the opening 311.

A protrusion 325 is formed at a portion of the periphery of the opening/closing member 320. A fastening hole 326 is formed through the protrusion 325, to enable the opening/closing member 320 to be completely coupled to the rear plate 18 by a fastening member. A fastening groove 181 is formed on the rear plate 18 at a position corresponding to the fastening hole 326 when the opening/closing member 320 closes the opening 311 of the frame 310.

A refractory material 400 is provided at an inner surface of the opening/closing member 320, to prevent the safety member, namely, the cover 300, from being burned. The reason why the refractory material 400 is provided is that, when an inflammable material is introduced into the drum 20 through carelessness of the user, it may be ignited by hot air supplied to the drum 20, so that a fire may break out in the drum 20. In this case, the refractory material 400 prevents the fire from the drum 20 from being propagated to the outside of the cabinet 10 after burning the steam hose 230 and cover 300.

Although the cabinet 120 is made of a metal material, the steam hose 230 and cover 300 are made of a molded rubber or plastic product. For this reason, the fire broken out in the drum 20 may be easily propagated via the steam hose 230 and cover 300.

For the refractory material 400, any material may be used, as long as it can prevent the fire broken out in the cabinet 20 from being propagated to the outside of the cabinet 10. For example, for the refractory material 400, a ceramic material may be bonded to the inner surface of the opening/closing member 320. Alternatively, for the refractory material 400, a refractory paint may be applied to the inner surface of the opening/closing member 320.

Figure 6:
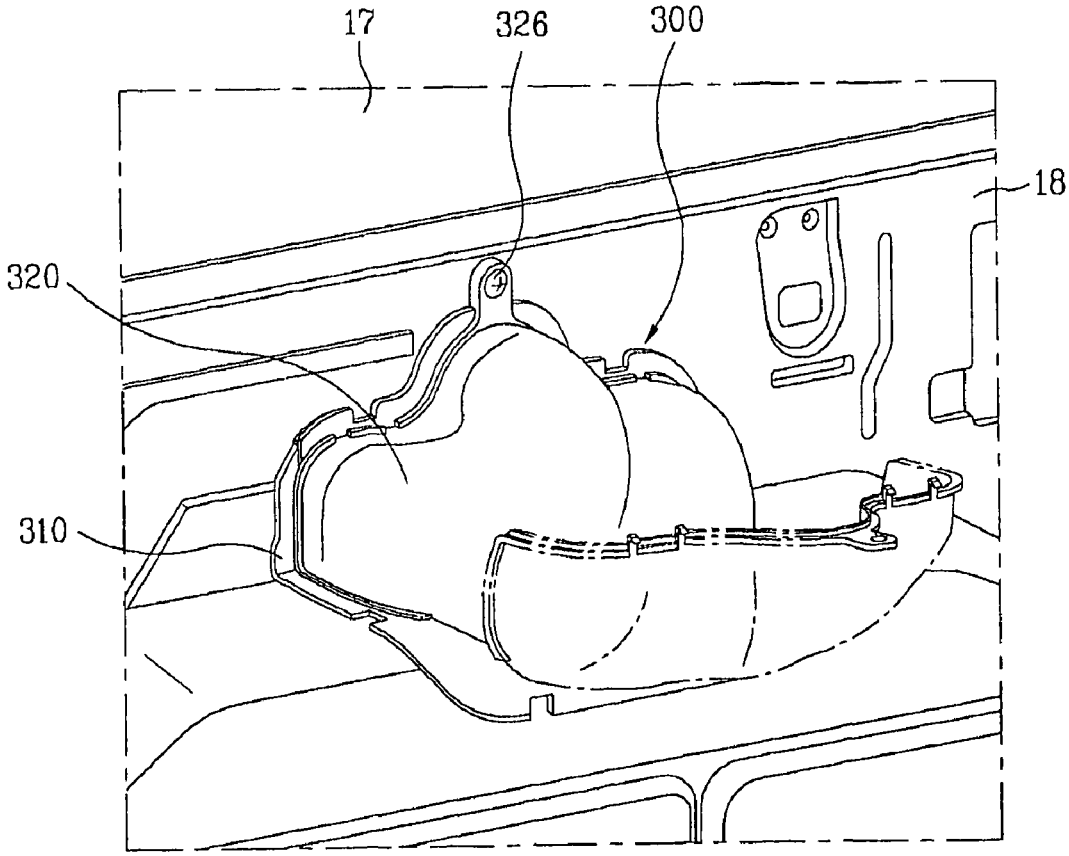
FIG. 6 is an enlarged view illustrating a state in which the cover shown in FIG. 5 is coupled to the dryer.

FIG. 6 illustrates a state in which the cover 300 according to the present invention is mounted to the rear plate 18 around the cutout 180, and the opening/closing member 320 of the cover 300 is fastened to the rear plate 18 by a screw.

The cutout 180 is arranged around the hose 230, as shown in FIG. 4. For this reason, the worker may be injured by the cutout 180 upon performing an assembly task for the hose 230 or other servicing tasks. Furthermore, the hose 230 may be damaged by the cutout 180 when it vibrates. In this regard, it is preferred that the cutout 180 be provided with a damage preventing member to prevent the substance supply device, in particular, the hose 230, from being damaged. The damage preventing member may be formed such that it encloses the cutout 180. Also, the damage preventing member may be provided at the cutout 180 such that it extends inwardly into the cutout 180. Accordingly, it is possible to effectively prevent the hose 230, etc. from being damaged by the cutout 180.

Of course, the damage preventing member may be formed to be integrated with the cover 300. That is, it is possible to achieve a desired damage preventing function by forming the frame 310 of the cover 300 such that the frame 310 has a shape corresponding to that of the cutout 180. In this case, several functions can be achieved through one element. Accordingly, there are effects of a reduction in material costs and manufacturing costs.

Hereinafter, the positional relation between the rear plate 18 and the cover 300 will be described in detail with reference to FIGS. 4 and 6.

The rear plate 18 includes a coupling portion 182*a*, which is coupled to the top plate forming the top wall of the dryer or to the rear supporter. Of course, the rear plate 18 may be coupled to the base 12 or side plates 14, through the coupling portion 182*a*.

The rear plate 18 also includes an extension 184*a* extending rearwardly from the coupling portion 182*a*, to form a rearmost surface of the dryer. To form the extension 184*a*, the rear plate 18 extends rearwardly at a portion thereof. That is, the rear plate 18 extends rearwardly at a position corresponding to the drum 20. In other words, the extension 184*a* is formed at a central portion of the rear plate 18. As a result, certain spaces are defined between the base 12 and the extension 184*a*, between each side plate 14 and the extension 184*a*, and the top plate 17 and the extension 184*a*, respectively. These spaces form working and connecting spaces for the connections of the dryer to an external electricity supply source, an external water tap, and an exhaustion port.

Bosses 185 or protrusions/grooves may be formed at the extension 184*a*, to increase the rigidity of the extension 184*a*. In this case, the bosses 185 form the rearmost surface of the dryer.

The rear plate 18 also includes a connecting portion 183, which connects the extension portion 184*a* and coupling portion 182*a*. Thus, the above-described spaces may be formed in a radial direction of the connecting portion 183.

In this case, the cutout 180 of the rear plate 18 may be formed through the connecting portion 183, or may be formed to extend along both the coupling portion 182*a* and the connecting portion 183. It is preferred that the cutout 180 be formed to extend along both the coupling portion 182*a* and the connecting portion 183, as shown in FIG. 4. This is because it is possible to expose, through the cutout 180, the portion of the rear supporter 40, from which the hose 230 extends, the hose 230, and a portion of the nozzle 250. Also, when the cutout 180 is formed at the above-described position, the rearmost surface of the cover 300 is positioned inwardly of the rearmost surface of the rear plate in a closed state of the cover 300. In this case, accordingly, it is possible to prevent the longitudinal length of the dryer from being increased due to the cover 300.

Where the bosses 185, etc. are formed at the extension 184*a* of the rear plate 18, the cutout 180 may also extend along the extension 184*a*. In this case, the worker can observe the portions exposed through the cutout 180 in an increased field of view. The working space is also widened.

Figure 7:
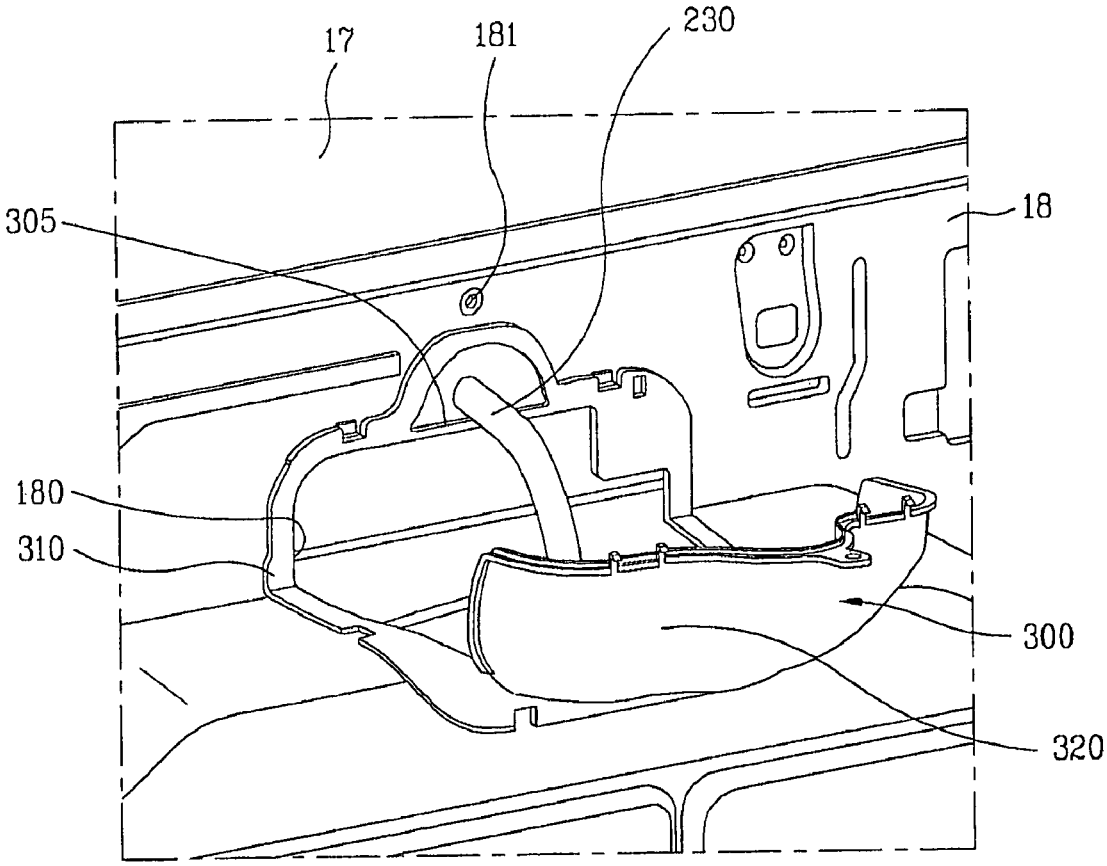
FIG. 7 is an enlarged view illustrating another embodiment of the cover shown in FIG. 5.

In this case, of course, it is preferred that the rearmost surface of the cover 300 be positioned inwardly of the rearmost surface formed by the bosses 185, FIG. 7 illustrates another embodiment of the cover.

As shown in FIG. 7, the cover 300 includes a connecting portion 305 formed to enclose the hose 230. As the hose 230 is enclosed by the connecting portion 305, it can be maintained in a fixed state. Also, it is possible to prevent the hose 230 from being damaged. It is also possible to increase the rigidity of the cover 300, in particular, the frame 310, through the connecting portion 305.

As apparent from the above description, the cutout 180 is formed through the rear plate 18 at a position corresponding to the installation position of the substance supply device in accordance with the present invention. Accordingly, the serviceability required to eliminate a failure occurring in the substance supply device can be enhanced.

Since the cover 300 is coupled to the rear plate 18, to cover the cutout 180 of the rear plate 18, it is possible to prevent the user from being subjected to an accident. Also, the cover 300 includes the opening/closing member 320 to selectively open the cutout 180 only when the substance supply device has failed, in order to repair the failed substance supply device. Accordingly, an enhancement in serviceability is achieved.

Also, it is unnecessary to provide an additional space for the cover 300. Accordingly, there is no increase in the longitudinal length of the dryer.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A dryer comprising:

a drum for accommodating an object to be dried;

a rear supporter configured to cover a rear side of the drum;

a substance supply device having an end arranged at the rear supporter, to supply a water-based substance to an interior of the drum;

a rear plate formed to constitute a rear wall of the dryer and comprising a cutout formed in the rear plate; and a cover configured to cover the cutout to selectively open and close the cutout wherein the cutout is formed to partially expose the substance supply device, wherein the rear plate further comprises;

a coupling portion coupled to a top plate constituting a top wall of the dryer or to the rear supporter; and an extension extending rearwardly from the coupling portion, to form a rearmost surface of the dryer; and a connecting portion connecting the coupling portion and the extension;

wherein the cutout is formed through the connecting portion, or is formed to extend along the coupling portion and the connecting portion.

2. The dryer according to claim 1, further comprising:

a damage preventing member provided at the cutout, to prevent the substance supply device from being damaged by the cutout.

3. The dryer according to claim 1, wherein the cutout is formed at an upper portion of the rear plate.

4. The dryer according to claim 1, wherein the substance supply device comprises a hose providing a substance flowing passage.

5. The dryer according to claim 4, wherein the hose is connected to the rear plate, and the cutout outwardly exposes a portion of the hose connected to the rear plate.

6. The dryer according to claim 4, wherein the substance supply device further comprises a nozzle provided at an end of the hose.

7. The dryer according to claim 6, wherein the nozzle is coupled to the rear supporter.

8. The dryer according to claim 1, wherein the water-based substance comprises mist sprayed under a water pressure.

9. The dryer according to claim 1, wherein the water-based substance comprises steam.

10. The dryer according to claim 9, further comprising:

a steam generator arranged inwardly of the rear supporter, to generate steam.

11. The dryer according to claim 10, wherein the substance supply device comprises a hose, and wherein one end of the hose is connected to the steam generator and the other end of the hose extends rearwardly beyond the rear support.

12. The dryer according to claim 1, wherein the cover selectively opens and closes the exposed portion of the substance supply device.

13. The dryer according to claim 1, wherein the cover is provided at the rear plate.

14. The dryer according to claim 1, wherein the cover comprises:

an opening and closing member pivotally movable between an opened position and a closed position; and a frame coupled to the rear plate, to support the opening and closing member such that the opening and closing member is pivotally movable.

15. The dryer according to claim 1, wherein the cover is arranged such that, when the cover closes the cutout, a rearmost surface of the cover is positioned inwardly of a rearmost surface of the rear plate.

16. The dryer according to claim 1, further comprising:

a refractory material provided at an inner surface of the cover.

17. The dryer according to claim 1, wherein the cover comprises a damage preventing member provided at the cutout to prevent the substance supply device from being damaged by the cutout.

* * * * *